US005378214A

United States Patent [19]

Kreitenberg

[11] Patent Number: 5,378,214

[45] Date of Patent: Jan. 3, 1995

[54] SELF-POWERED HUMAN CENTRIFUGE

[76] Inventor: Arthur Kreitenberg, 12216 Shetland La., Los Angeles, Calif. 90049

[21] Appl. No.: 898,416

[22] Filed: Jun. 15, 1992

[51] Int. Cl.[6] ..... A63B 21/00; A63G 1/12

[52] U.S. Cl. ..... 482/57; 472/33; 472/21

[58] Field of Search ..... 482/57, 62, 63, 65, 482/95, 96; 472/21, 33, 15

[56] References Cited

U.S. PATENT DOCUMENTS

| | | | |
|---|---|---|---|
| 333,448 | 12/1885 | Crispin | 472/15 |
| 2,144,206 | 1/1939 | Thompson | 482/57 |
| 3,024,023 | 3/1962 | Steller | 482/63 |
| 3,662,747 | 5/1972 | Williams | 482/57 |
| 4,060,241 | 11/1977 | Hegel | 482/63 |
| 4,428,576 | 1/1984 | Fisher | 472/33 |
| 4,957,282 | 9/1990 | Wakefield | 472/21 |
| 5,011,133 | 4/1991 | Myers | 482/57 |
| 5,042,795 | 8/1991 | Bursik | 482/65 |

*Primary Examiner*—Stephen R. Crow

[57] ABSTRACT

A self powered human centrifuge for simulating gravity and providing an aerobic workout as a countermeasure to the adverse physiological effects of prolonged spaceflight. A frame rotates about a stationary shaft located above the head of the rider. Power is provided by the rider via pedals and handles in a bicycle type apparatus. A plurality of gears may be selected using a derailleur and freewheel. A brake may be used to increase resistance and thus workout intensity. A cam and roller device at the foot crankset simulates impact loading of normal earth walking.

9 Claims, 4 Drawing Sheets

SELF-POWERED HUMAN CENTRIFUGE

BACKGROUND

This invention relates to human centrifuges. In particular, it relates to a self powered human centrifuge for use during periods of prolonged weightlessness in space.

During prolonged spaceflight, lack of gravity has many adverse effects on the human organism. These include cardiopulmonary deconditioning, shifts in body fluids and wasting of musculoskeletal structures.

On Earth, humans depend on gravity, a force defined as one "g", for many physiologic functions. In orbit or in prolonged spaceflight, conditions of near-zero "g" or "microgravity" exist. The physiologic effects of this environment have been extensively studied.

Humans will be subjected to prolonged periods of microgravity in the coming decades. A manned mars mission, slated for the first half of the twenty-first century will require over two years to complete the round-trip journey.

Existing experience has involved a limited number of subjects with microgravity durations of less than one year. From these data we know that returning subjects report dizziness and weakness sufficient to preclude walking. Most of these effects appear to be reversible with time on earth. The results of longer duration exposure is unknown.

The cardiopulmonary effects of flights greater than two weeks have demonstrated a 12% decrease in stroke volume (the amount of blood pumped per heart contraction) and an 11% decrease in left cardiac muscle thickness. The exercise capacity is decreased. Recovery time is related to the amount of inflight exercise rather than the mission duration.

Significant shifts in body fluid occur from the lower to the upper body in microgravity. In the upright position on earth, gravity holds fluids in the lower extremities. Muscles and venous valves help return fluid to the heart. Without gravity, fluids shift away from the legs. Leg volume decreases exponentially in the first 24 hours and plateaus within 3 to 5 days. With prolonged flights, a 15% decrease in calf circumference develops. Photographs of subjects' puffy faces attest to this effect. Subjects often complain of congestion.

Upon return to earth gravity, the fluid is rapidly shifted back to the lower extremities. This effect, known as orthostatic hypotension, can cause dizziness and loss of consciousness with disastrous results during re-entry and landing. Countermeasures such as ingestion of high-salt solutions and inflight use of a Lower Body Negative Pressure device can limit these effects. Positive pressure lower body suits are also utilized.

The effects of microgravity on the skeletal system are profound. Data from Soviet studies of the heel bone reveal bone loss in rough proportion to mission length with losses of up to 19.8% in flights up to 184 days. Some studies suggest that these losses may be irreversible upon return to earth. Urinary and fecal calcium losses persist throughout flight, raising the possibility of kidney stone formation. It has been calculated that one year in flight may result in sufficient undermining of bone strength so as to cause fracture. The presence of gravity as well as "impact loading" as occurs in normal walking are felt to be important in skeletal mass preservation.

Additional effects of microgravity have been noted in vestibular (balance), muscular, hormonal and other systems.

A currently used countermeasure is the exercise bicycle which is mounted to the space vehicle. A harness is utilized to keep the astronaut on the seat during exercise. Effective aerobic exercise is obtained. While pushing down on the pedals and being harnessed in, the astronaut can also generate a type of "weight bearing" of the lower extremities.

This stationary bicycle, however, does not produce a gravitational field. Body structures, such as the inner ear respond only to accelerations as in a gravitational field. Recent research indicates that some cells in the body are sensitive to gravitational fields. Therefore, it is desirable to produce such a gravitational field during prolonged spaceflight.

It is reasonable to assume that the temporary availability of a gravitational field during prolonged microgravity exposure will obviate some of these adverse consequences. A system for providing exercise as well as simulated gravity would be of considerable value for prolonged space flight.

SUMMARY

This invention relates to a human centrifuge which is self-powered with a bicycle-like pedal mechanism. The centrifuge provides a gravitational field, and the driving mechanism provides a means of exercise.

At a rotational rate of 0.5 cycles per second, the center of gravity of the body, estimated to be one meter from the rotational axis, will experience approximately one "g" of acceleration. The feet, at approximately two meters from the rotational access will experience roughly two "g" of acceleration.

DRAWINGS

DESCRIPTION

Figure 1:
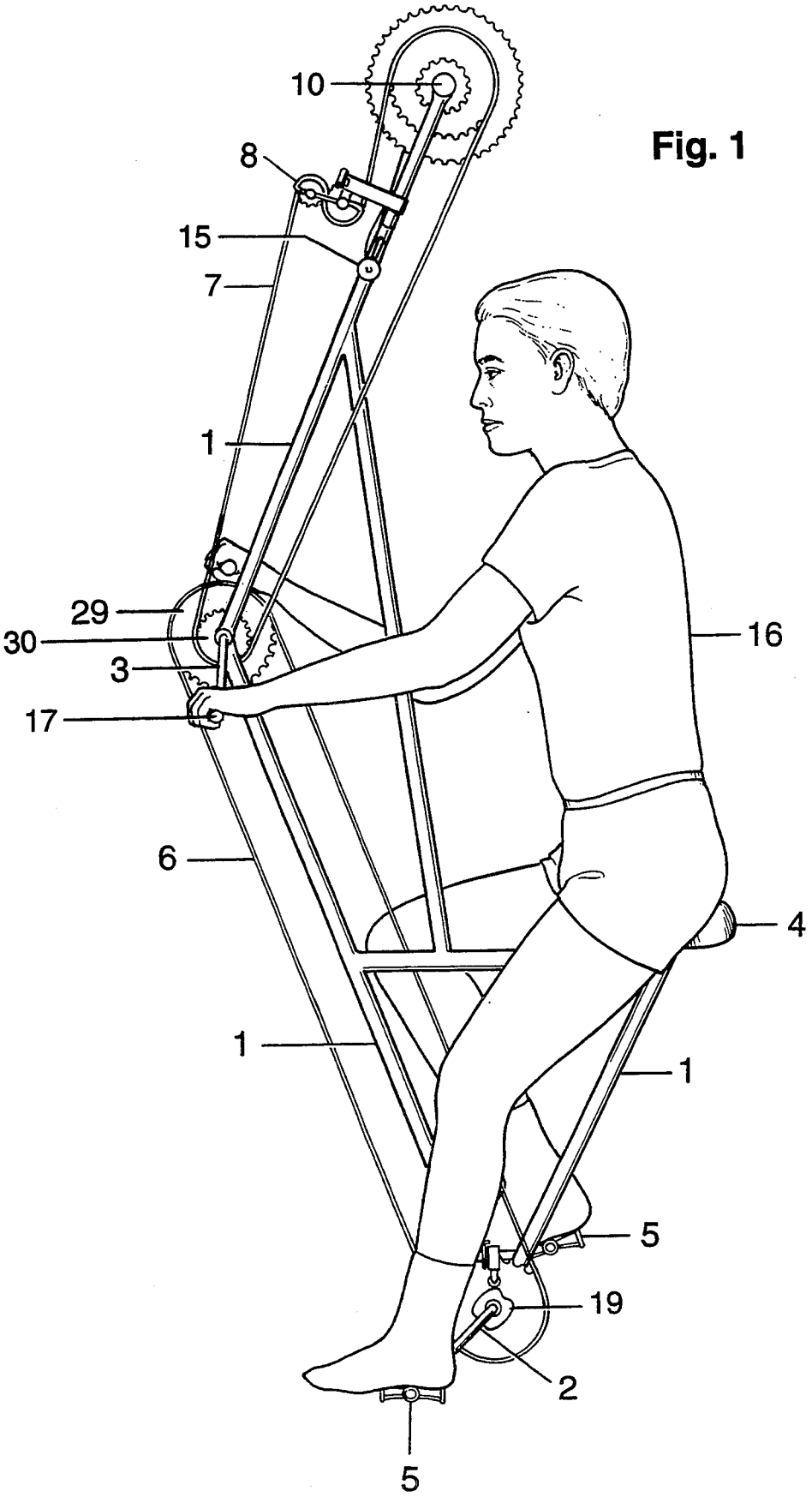
FIG. 1 shows a side view of the entire device with a rider in place.

A typical embodiment of the device is illustrated in FIG. 1. The components of the invention are attached to a frame 1, preferably made of a lightweight rigid material such as aluminum or fiberglass. A rider 16 sits on a seat or saddle 4. The rider's feet 16 are placed on pedals 5 and the handles 17 are grasped with the hands.

The pedals 5 are attached to a foot crankset 2 as is commonly employed in a bicycle. The foot crankset 2 has a chainwheel 28 to engage a standard bicycle chain, known as the lower chain 6.

The hand crankset 3, is composed of handles 17, and two chainwheels, 29 and 30, which are fixed to each other in a construction commonly used for the front rider on a tandem bicycle. The lower chain 6, at its upper end, engages chainwheel 29 on the hand crankset 3. The second chainwheel 30 engages an upper chain 7, also a standard bicycle chain.

The upper chain 7 passes through a frame 1 mounted derailleur 8, of a standard 10-speed bicycle type. After passing through the derailleur 8, the upper portion of the upper chain 7 engages a freewheel 11, composed of sprockets of different radii of the sort commonly used on 10-speed bicycles. The freewheel 11 contains a standard pawl-ratchet mechanism which allows engagement of the shaft 10 in only one rotational direction. In the opposite direction, the freewheel 11 rotates freely with respect to the shaft 10. The ends of the shaft 10 are rigidly affixed to the spacecraft so that it does not rotate or translate with respect to the spacecraft. The shaft 10 is engaged at the superior end of the frame 1, horizontally at a location superior to the rider's 16 head.

Figure 2:
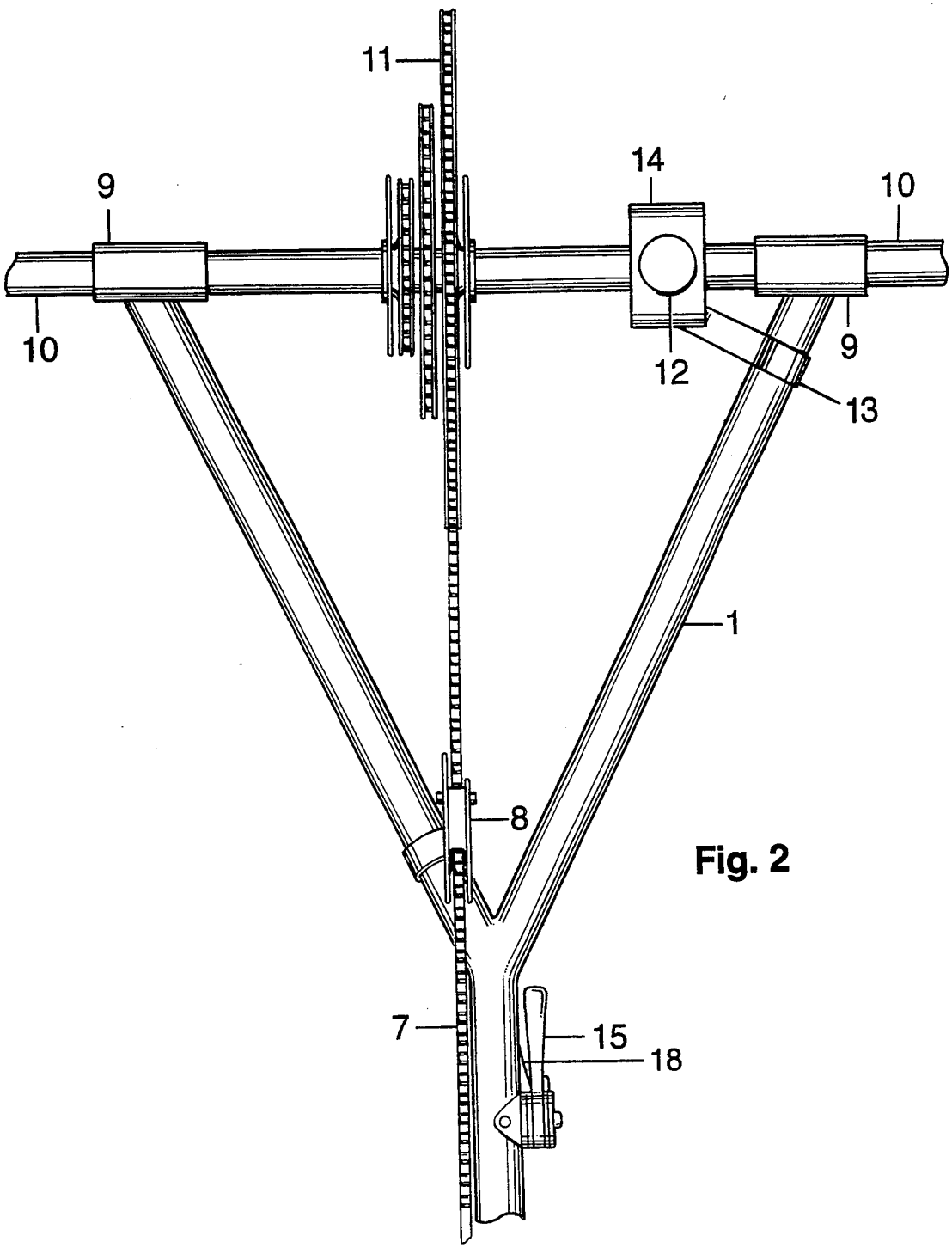
FIG. 2 shows a front view of the upper part of the device.

FIG. 2 shows a front view of the upper part of the invention. The frame 1 attaches to the shaft 10 by two bearings 9, which allow low friction rotation of the frame 1 with respect to the shaft 10. The frame 1 is a "Y" configuration which provides stability. The upper chain 7 is shown passing through the derailleur 8 and engaging one of the sprockets of the freewheel 11. The derailleur 8 is attached to a gearshift cable 18, which in turn is connected to a gearshift lever 15. The gearshift lever 15 is mounted on the frame 1 to allow easy access for the rider's 16 hand.

A brake housing 14 is mounted onto the frame 1 by a brake mount 13. The brake knob 12 emanates from the lower part of the brake housing 14 at a position which allows easy access for the rider's 16 hand.

Figure 3:
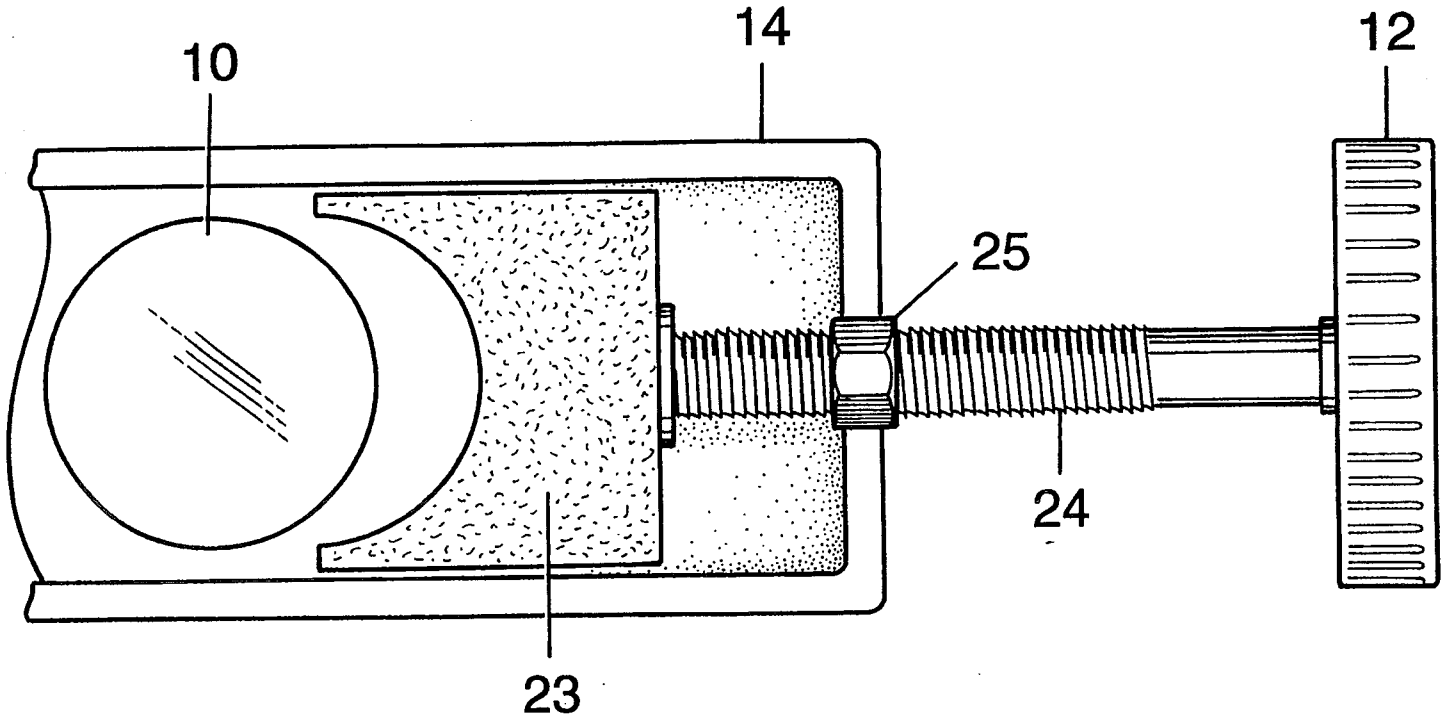
FIG. 3 shows a side view of the brake mechanism.

FIG. 3 shows a side view of the brake. The brake housing 14 contains a brake shaft engaging nut 25 which has threads engaging the brake shaft 24. The lower end of the brake shaft 24 is rigidly attached to a brake knob 12. The upper end of the brake shaft 24 abuts the braking material 23 which is preferably composed of a high friction compound which does not ablate the shaft 10 which it contacts.

Figure 4:
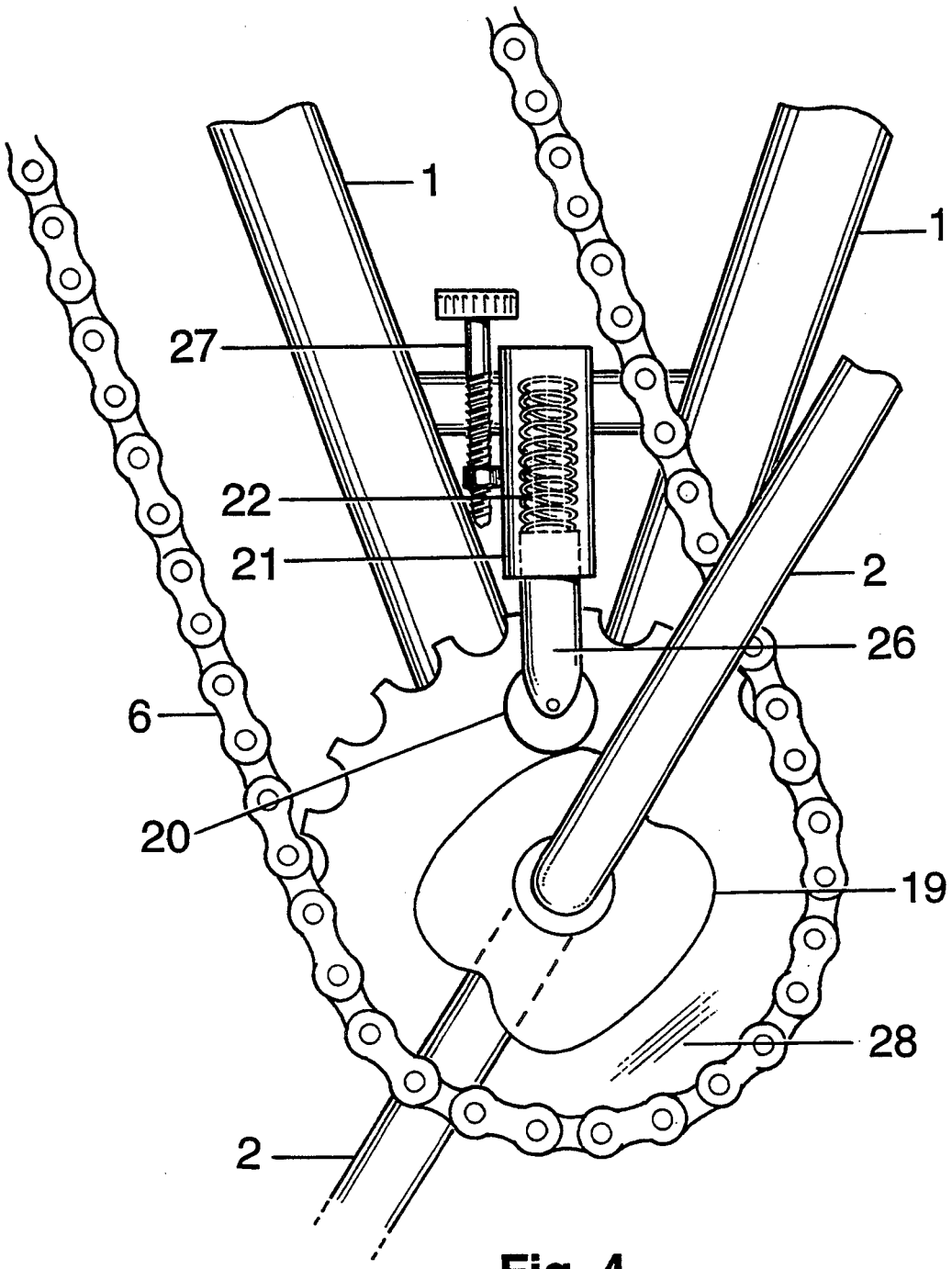
FIG. 4 shows a side view of the lower foot crankset apparatus.

FIG. 4 shows the lower end of the device. The lower chain 6 is seen engaging the chainwheel 28 of the foot crankset 2. Rigidly attached concentrically at the intersection between its greater and lesser diameters to the chainwheel 28 of the foot crankset 2 is an impact loader cam 19.

The impact loader cam 19 is shaped symmetrically and is out of round so as to meet an impact loader roller 20 at the greater radii of the cam 19. The impact loader roller 20 is mounted on an impact loader piston 26. The impact loader piston 26 is spring 22 loaded in an impact loader cylinder 21. The impact loader cylinder 21 is attached to the frame 1 so that the distance from the impact loader roller 20 to the impact loader cam 19 is adjustable by rotating impact load adjuster bolt 27.

The impact loader cam 19 is mounted to the chainwheel 28 so that maximum displacement of impact loader roller 20 occurs at or near the bottom of the pedal 5 cycle. The cam 19 may be shaped so that during operation, pedal 5 resistance simulates the force of the ground on each foot during normal earth gravity walking.

Operation—FIGS. 1 through 4

FIG. 1 shows how the rider 16 sits on the saddle 4 with feet on the pedals 5 and hands on the handles 17. The hands and feet are made to rotate their respective cranksets 3, 2. The lower chain 6 and the upper chain 7 are thus driven to travel along their courses. The upper chain 7 engages the freewheel 11 which in turn engages the shaft 10.

The shaft 10 is rigidly mounted to the spacecraft and the frame 1 is free to rotate about the shaft i on the bearings 9. The entire frame 1 with all its components and the rider 16 therefore rotate about the shaft 10.

FIG. 2 shows how a rider may change the ratio between the pedal rotational speed and frame rotational speed. The gear shift lever 15 is adjusted so that a different sprocket of the freewheel 11 is selected. This is analogous to a standard multi-gear bicycle.

The brake mechanism depicted in FIGS. 2 and 3 has two purposes. When the rider 16 wishes to slow down or complete a session, the brake knob 12 is turned so as to abut the braking material 23 against the shaft 10 and slow the rotational speed. The second purpose is to increase the rotational resistance should the rider 16 desire greater cardiopulmonary exertion during the session. The desired resistance is dialed in using the brake knob 12.

FIG. 4 illustrates the impact loader, which is designed to simulate the impact loading experienced by the lower extremities during normal earth walking. As each pedal 5 approaches the bottom of its path, the impact loader cam 19 meets the impact loader roller 20 which retracts into the impact loader cylinder 21 as the pedal 5 passes. The impact loader spring 22 provides momentary resistance during each pedal 5 downstroke. The impact loader spring 22 also returns the impact loader roller 20 to a ready position. By rotating impact load adjuster bolt 27, the impact loader cylinder 21 is translated so that the distance between the impact loader cam 19 and roller 20 adjustable to the desired level of impact load.

The Self Powered Human Centrifuge provides a reliable, simple, practical countermeasure to the adverse physiological effects of prolonged weightlessness associated with spaceflight. Furthermore, it provides:

- an effective cardiopulmonary workout to prevent deconditioning as well as a means of varying the intensity of the workout;
- simulated gravity to shift fluid back to the lower body and legs, maintaining the vascular tone of the legs;
- simulated gravity for the preservation of skeletal mass;
- impact loading of the lower extremities felt to be important in the prevention of osteoporosis.

Although the description above contains many specificities, these should not be construed as limiting the scope of the invention but merely as providing illustrations of some of the presently preferred embodiments of this invention. For example, a shaft drive may be utilized instead of a chain drive.

Additional features which could be added include a chain casing to protect the rider from the chain, an adjustable seat post to allow riders of different sizes, a frame mounted video monitor to provide education or entertainment during a session. The handles and/or pedals could be folded out of the way to allow workout of only the legs or only the arms. The entire frame could be made to fold in half at the hand crankset location to allow for minimum stowage space. The brake can be of the drum variety used in some bicycles. The entire device may be cordoned off to protect the rider from objects floating in the vicinity.

I claim:

1. A self propelled human centrifuge for use in spaceflight comprising:

(a) a stationary shaft connected to a main support, (b) a frame having a user support rotatably coupled to said shaft, such that when a user is positioned on the user support, the user's head always remains proximal to the shaft while the user's feet remain distal to said shaft, said shaft located superior to the user's head, (c) human powered driving means comprising user input means and transmission means for rotating said frame and user 360 degrees around said shaft.

2. The centrifuge of claim 1 including a foot crankset for receiving the feet of a human, such that the legs of the human provide power for the driving means.

3. The centrifuge of claim 1 including a hand crankset for receiving the hands of a human such that the arms of the human provide power for the driving means.

4. The centrifuge of claim 1 further including a chain and freewheel means to transmit a propelling force to the frame.

5. The centrifuge of claim 2 further including gear-shift means and derailleur means for varying the crankset rotational speed relative to the frame rotational speed.

6. The centrifuge of claim 1 further including a frictional brake means between the frame and said shaft and means for controllably varying the contact of the brake means on the shaft.

7. The centrifuge of claim 2 further including means for providing a variable resistive force to rotational motion of the crankset.

8. The self powered human centrifuge of claim 1 further comprising:

(a) a cam attached substantially concentrically at the intersection between its greater and smaller diameters to said crankset, the crankset being connected with pedals for receiving the feet of a human, said cam adapted so as to impart symmetrically to each pedal and foot resistive forces simulating the ground reaction force profile of normal earth walking;

(b) roller means for contacting the cam at the greater radii of said cam; and (c) means for mounting the roller to provide resistance to rotation of the crankset, the resistance being capable of being varied.

9. The rotational resistance device of claim 8 including a piston connected with the roller, the piston being contained in a cylinder, and a spring contained in the cylinder for providing resistance to rotation of said crankset.

* * * * *